US005526901A

United States Patent [19]

Salmon

[11] Patent Number: 5,526,901

[45] Date of Patent: Jun. 18, 1996

[54] TWO CAR ELEVATOR SYSTEM

[75] Inventor: John K. Salmon, South Windsor, Conn.

[73] Assignee: Otis Elevator Company, Farmington, Conn.

[21] Appl. No.: 276,013

[22] Filed: Jul. 15, 1994

[51] Int. Cl.[6] ..... B66B 9/00

[52] U.S. Cl. ..... 187/249; 187/254; 187/266; 187/412

[58] Field of Search ..... 187/249, 254, 187/266, 292, 412

[56] References Cited

U.S. PATENT DOCUMENTS

| | | | |
|---|---|---|---|
| 849,840 | 4/1907 | Foster | 187/249 |
| 1,837,643 | 12/1931 | Anderson | 187/249 |
| 1,896,776 | 2/1933 | James | 187/249 |
| 1,976,495 | 10/1934 | Halfvarson | 187/249 |

*Primary Examiner*—William E. Terrell
*Assistant Examiner*—Dean A. Reichard

[57] ABSTRACT

An elevator is provided comprising a first car, a second car, and a counterweight for travel within a hoistway. A plurality of ropes connect the first and second cars to the counterweight for travel within the hoistway. A machine is provided for driving the cars and counterweight within the hoistway. The plurality of ropes are arranged to cause the second car to travel 1/N of the distance, at 1/N of the speed, of the first car when the machine is driving the cars.

19 Claims, 2 Drawing Sheets

TWO CAR ELEVATOR SYSTEM

BACKGROUND OF THE INVENTION

1. Technical Field

This invention relates to elevators in general, and more specifically to elevators having more than one car.

2. Background Information

Elevators typically consist of an elevator car and a counterweight for travel within a hoistway. A plurality of ropes extending up to the top of the hoistway mechanically connect the car and the counterweight together. In a 1:1 roping arrangement, the ropes attach directly to the car and the counterweight. In a 2:1 roping arrangement, a sheave is mounted on the top of the car, or on the top of the counterweight, or both, to route the ropes back up the hoistway to a fixed position within the hoistway.

The car and counterweight may be driven within the hoistway by either a powered sheave or a motor driven counterweight. The powered sheave is fixed at the top of the hoistway and may or may not be used in conjunction with one or more idler sheaves. The motor driven counterweight also uses sheaves at the top of the hoistway, but the means for driving the car and counterweight is a linear motor attached to the counterweight frame.

A tension within high-rise building design is the need for effective elevatoring versus the amount of non-income producing space required by the elevators. Buildings must possess elevators having sufficient capacity and control to efficiently convey passengers at peak traffic times. The simplest way to satisfy this requirement is to design a building with excess elevator capacity to handle the peak traffic loads. Excess elevators may satisfy the peak traffic needs of the building, but they also reduce the amount of income producing space in a building and are therefore in conflict with the goal of maximizing income generating space.

One method for decreasing the building space requirements of elevators within a building without adversely effecting the capacity of the elevators is to use 2:1 roping on the counterweight of each elevator. A 2:1 roped counterweight only travels half as far as the 1:1 car to which it is connected and therefore only requires half the space normally necessary for the counterweight. A disadvantage of this method is that the area under the counterweight must be reinforced to handle the impact of the counterweight in the event of a free fall. Another method for increasing the capacity of a building's elevatoring is to employ tandem or "double-decker" elevator cars where one car is attached to the top of the other car. The theoretical capacity of an elevator shaft could be doubled with such an arrangement. Realistically, however, elevator traffic may not be best served when two cars always stop at adjacent floors. Double-decker cars are also larger in mass and therefore require a heavier counterweight and other equipment such as larger capacity safety buffers and sheaves.

DISCLOSURE OF THE INVENTION

It is, therefore, an object of the present invention to provide an elevator system with an increased passenger capacity rate per elevator shaft.

It is another object of the present invention to provide an elevator system that uses a minimum of space within a building.

It is a further object of the present invention to provide an elevator system that enhances the architectural style of the building.

According to the present invention, an elevator is provided comprising a first car, a second car, and a counterweight for travel within a hoistway. A plurality of ropes connect the first and second cars to the counterweight for travel within the hoistway. A machine is provided for driving the cars and counterweight within the hoistway. The plurality of ropes are arranged to cause the second car to travel 1/N of the distance, at 1/N of the speed, of the first car when the machine is driving the cars, where the value of N is dependent upon the specific roping arrangement. For instance, in a 2:1 roping arrangement, the value of N is 2.

According to one aspect of the present invention the plurality of ropes are arranged to cause the second car to travel one-half (½) the distance, at one-half (½) the speed, of the first car when the machine is driving the cars.

According to one embodiment of the present invention, the counterweight is roped in a 2:1 roping arrangement.

According to another aspect of the present invention, a method for minimizing car jump in a roped elevator is provided.

An advantage of the present invention is that the elevatoring capacity of a building may be greatly enhanced without increasing the space required.

Another advantage of the present invention is that an elevator is provided with two cars that can access more than just floors adjacent one another.

Still another advantage of the present invention is that car jump is significantly reduced. "Car jump" is a term of art used to refer to the situation when a car and ,counterweight are traveling within a hoistway and the car or counterweight, whichever is traveling downward, comes to an abrupt stop. The other of the car or counterweight will not stop immediately, but rather will be carried upward a distance by its inertia. Hence, the car or counterweight is said to "jump" or become "weightless". The degree of weightlessness or the amount of jump depends upon the upward velocity and acceleration of the object and how much they offset the downward acceleration of gravity.

Car jump is a serious safety consideration to be considered in the design of an elevator. In the present invention, the acceleration and velocity of the first car roped 1:1 will always be approximately twice that of the second car roped 2:1. Because the acceleration and velocity of the second car is only one half that of the first car, in a counterweight braking situation the second car will only be one half as "weightless" (i.e., half the inertia) as the first car, assuming that the two cars are approximately the same weight. The remaining effective weight of the second car acts on the first car via the ropes attaching the two cars. Hence, the first car will always have the additional weight of the second car to prevent it from becoming weightless.

These and other objects, features and advantages of the present invention will become more apparent in light of the detailed description of the best mode embodiment thereof, as illustrated in the accompanying drawings.

BEST MODE FOR CARRYING OUT THE INVENTION

Figure 1:
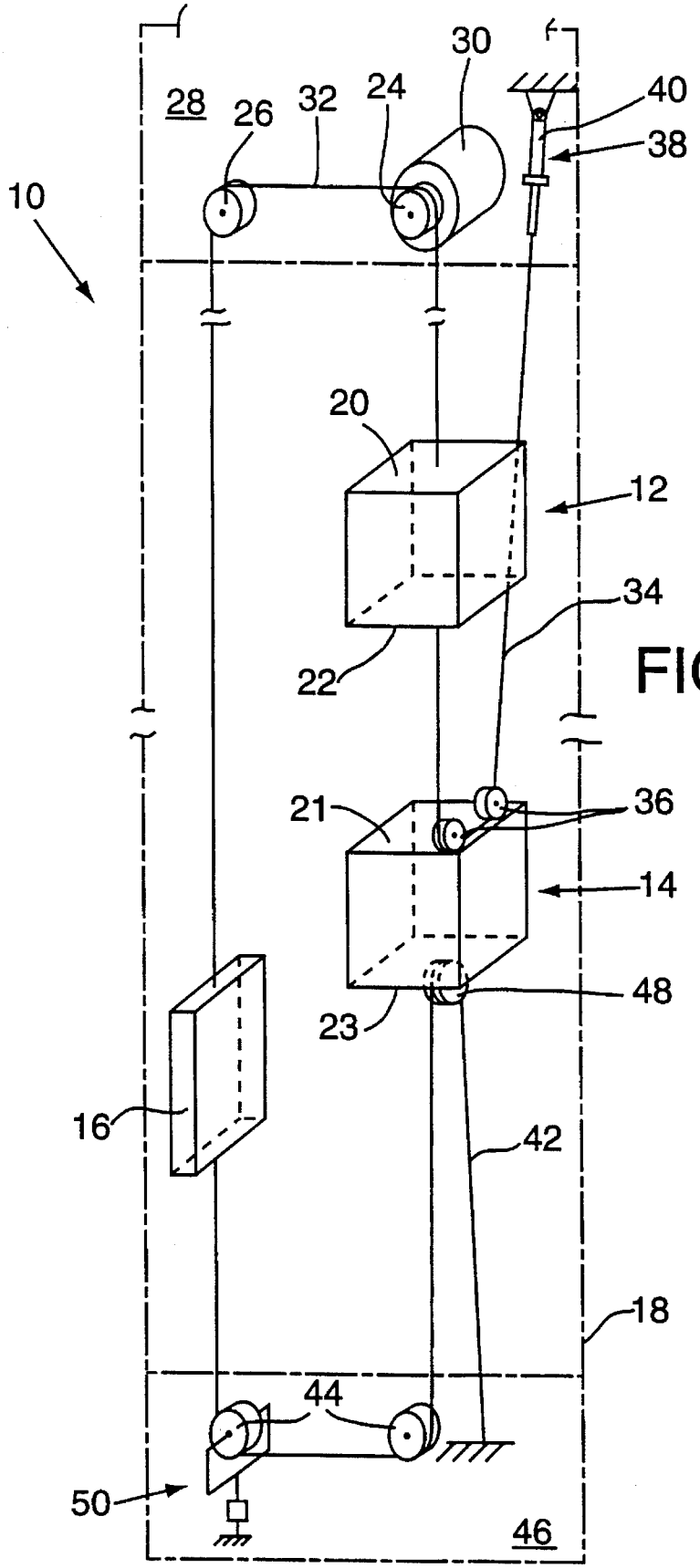
FIG. 1 is a diagrammatic view of an elevator, with 1:1 roping on the counterweight.

Now referring to FIG. 1, an elevator 10 is shown having a first car 12, a second car 14, and a counterweight 16 for travel in a hoistway 18. The hoistway 18, as is known in the art, extends vertically within the building or structure and includes a plurality of landings (not shown) at which one of the elevator cars 12,14 may stop. The first 12 and second 14 cars are shown diagrammatically in FIG. 1, each having a top 20,21 and a bottom 22,23, respectively. The first car 12 is positioned above the second car 14 in the hoistway 18. Guiderails (not shown) guide the cars 12, 14 along a common path within the hoistway 18. The counterweight 16 is guided by a second set of guiderails (not shown) along a parallel path adjacent the cars 12, 14.

A pair of sheaves 24,26 are located in the machine room 28 at the top of the hoistway 18 above the cars 12, 14 and counterweight 16. In a first embodiment, one of the sheaves 24 is a drive sheave having a pay-on/pay-off point located directly above the cars 12,14. The drive sheave 24 is a sheave attached to a machine 30 for driving the cars 12,14 and counterweight 16 within the hoistway 18. The other sheave 26 is a deflector sheave having a pay-on/pay-off point positioned above the counterweight 16. The deflector sheave 26 aligns and guides the ropes 32 coming from the drive sheave 24 and extending down to the counterweight 16. A person of skill in the art will recognize that a variety of drive sheave 24 and deflector sheave 26 combinations are known in the art for purposes of alignment and traction. An elevator 10 may, alternatively, have only a drive sheave 24, where the diameter of the drive sheave 24 is large enough to adequately align the ropes above the cars 12,14 and counterweight 16. The example given of a drive sheave 24 and a single deflector sheave 26 is not intended to limit the present invention, as other roping arrangements may be used alternatively.

A first 32 and second 34 plurality of ropes connect the first car 12, second car 14, and counterweight 16 within the hoistway 18. The second plurality 34 of ropes are attached on one end to the bottom 22 of the first car 12. From there, the second plurality 34 of ropes extend down the hoistway 18 to a pair of sheaves 36 attached to the top 21 of the second car 14, around the sheaves 36 and back up the hoistway 18 to a compensator 38 fixed to the hoistway 18 above the cars 12,14. Hence, the second car 14 is roped in a 2:1 arrangement. Alternatively, the second car could be roped in a 3:1 or other N:1 roping arrangement.

In the preferred embodiment, the compensator 38 is an apparatus having a hydraulic cylinder 40 with a stroke. Alternatively, the compensator 38 may be another linear motion device such as, but not limited to, a geared drive imparting linear motion to a chain or a toothed rack, etc. The magnitude of the linear motion of the compensator 38 is determined by the maximum distance necessary to level the first 12 and second 14 cars at a pair of particular landings as will be discussed infra.

The first plurality 32 of ropes, in a first embodiment shown in FIG. 1, are attached to the top 20 of the first car 12 and extend up the hoistway 18 to the drive sheave 24 located thereabove. The ropes 32 wrap around the drive sheave 24 and the deflector sheave 26 and extend back down the hoistway 18, attaching on the other end to the counterweight 16. In this configuration, the counterweight 16 is roped in a 1:1 arrangement and will travel a distance equal to that traveled by the first car 12.

Figure 2:
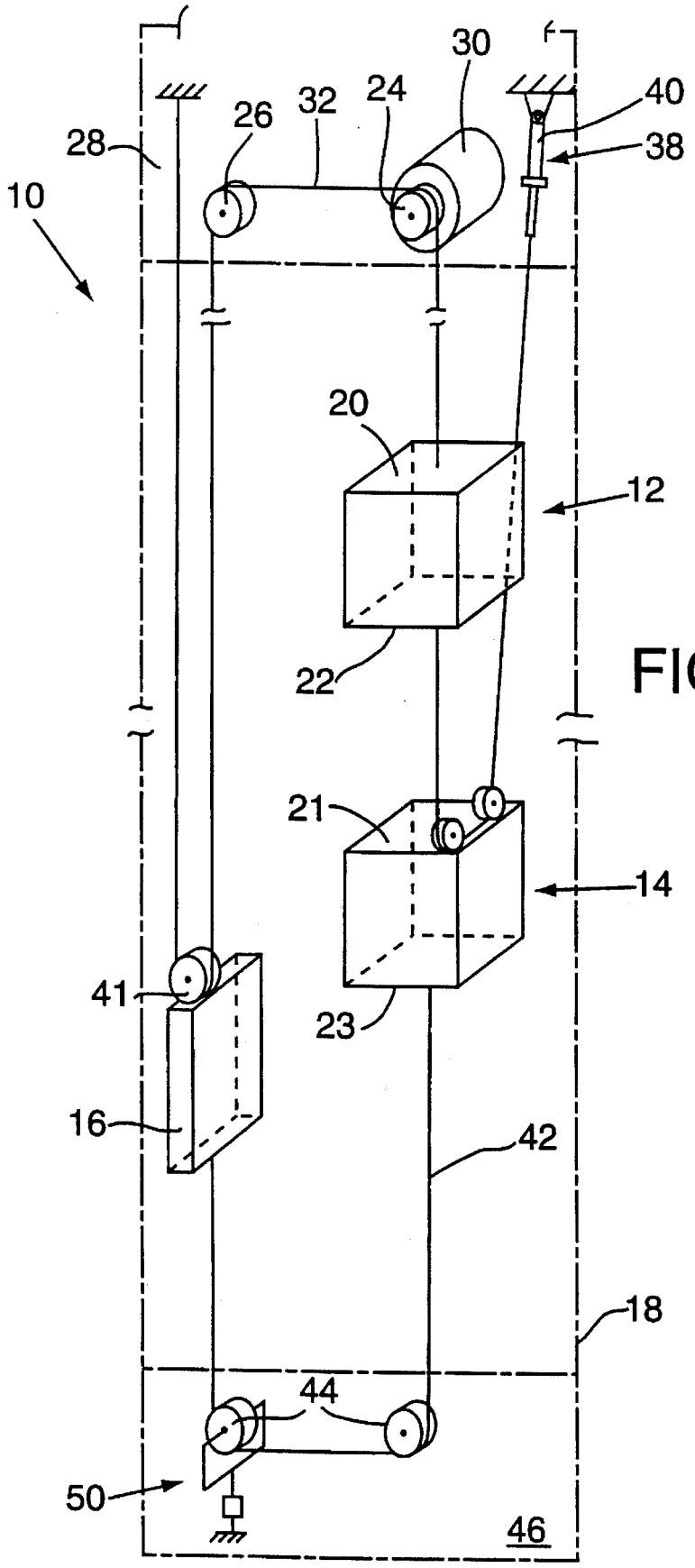
FIG. 2 is a diagrammatic view of the elevator shown in FIG. 1, with 2:1 roping on the counterweight.

In a second embodiment shown in FIG. 2, the ropes 32 are attached to the top 20 of the first car 12 and extend up the hoistway 18 to the drive sheave 24 located thereabove. The ropes 32 wrap around the drive sheave 24 and the deflector sheave 26 and extend back down the hoistway 18 to a sheave 41 attached to the top of the counterweight 16. The ropes 32 wrap around the counterweight sheave 41 and extend back up the hoistway 18, attaching on the other end to the hoistway 18 above the counterweight 16. In this configuration, the counterweight 16 is roped in a 2:1 arrangement and will travel a distance equal to one half that traveled by the first car 12.

A plurality of compensating ropes 42 are attached to the second car 14 and the counterweight 16. The ropes 42 attach to the bottom of the counterweight 16 and extend down the hoistway 18 to a pair of compensating rope sheaves 44 located in the pit 46 of the hoistway 18. The compensating ropes 42 wrap around the sheaves 44, extend back up the hoistway 18, and attach to the bottom 23 of the second car 14 as shown in FIG. 2. FIG. 1 shows an alternative roping arrangement for the compensating ropes 42 which includes a sheave 48 attached to the bottom 23 of the second car 14. In this arrangement, the compensating ropes 42 are attached to the second car 14 in a 2:1 roping arrangement. A person of skill in the art will recognize that a variety of compensating rope 42 and sheave 44 arrangements may be used in the pit 46.

A means 50 for dissipating vertical forces applied to the sheaves 44 by the compensating ropes 42 is included. As is known in the art, the means 50 for dissipating vertical forces may comprise a spring mount, a ratchet and pawl stroke limiter, or a fluid cylinder type shock absorber for one or more of the compensating sheaves 44. FIGS. 1 and 2 diagrammatically show a fluid cylinder type tie down shock absorbing device.

It is known in the art to position buffers (not shown) in the pit 46 of the hoistway 18 underneath the car 14 and counterweight 16 to dissipate the energy of the car 14 or counterweight 16 entering the pit 46. In the present invention, a first buffer (not shown) is positioned underneath the second car. A pair of second buffers (not shown) are positioned outside of the travel path of the second car, above where the second car would rest at its lowest position. Extensions (not shown) attached to the safety plank of the first car are aligned with the second buffers, such that they will strike the second buffers and stop the first car before the first car strikes the second car therebelow.

In the operation of the elevator 10, the present invention may service a building in a variety of configurations. In one configuration the elevator 10 is devoted to servicing a pair of sky lobbies and two lobby level landings. Specifically, the second car 14 of the elevator 10, at its lowest position, is stationed at the first floor lobby and is designated as servicing the lower sky lobby on the "$N^{th}$" floor. The first car 12 of the elevator 10, at its lowest position, is stationed at the second floor lobby and is designated as servicing the upper sky lobby on the "$Y^{th}$" floor, where the integer value of "Y" is twice that of "N". In this configuration, the compensator 38 would be used to level the second car 14 at the "$N^{th}$" landing if necessary.

In a second configuration, the hoistway 18 includes two lobby level landings on a first floor and a second floor. The second car 14 of the elevator, at its lowest position, is stationed at the first floor lobby and is designated as servicing floors 1 through "N". The first car 12 of the elevator, at its lowest position, is stationed at the second floor lobby and is designated as servicing floors 2 through "Y", where the integer value of "Y" is twice that of "N". If the building is designed to have the second car service floors 1–40, for example, the first car 12 would service floors 2–80.

Control of the first 12 and second 14 cars is common to both cars. For example, if a car call is made to bring the first car 12 to the tenth floor, the second car 14 will automatically be brought to the fifth floor. Likewise, if a car call is made to bring the second car 14 to the tenth floor, then the first car 12 will be brought to the twentieth floor. The door of either car 12,14 will open at the landing it arrives at if there was a car call made coinciding with the landing the car arrived at. For example, if a car call is made directing the second car 14 to the eighth floor and a car call is made directing the first car 12 to the sixteenth floor, then the car doors will open at the eighth and sixteenth floor landings, respectively. If there is only one car call made and it directs the second car 14 to the eighth floor landing, then the doors of the first car 12 will not open at the sixteenth floor. Other door control schemes may be used alternatively.

Ifa car call is made directing the first car 12 to an odd number floor, the second car 14 may be directed to the floor above or below where it normally would stop relative to the odd numbered floor the first car 12 has been directed to, depending on whether or not a car call was made directing the second car 14 to one of those floors. For example, if the first car 12 was directed to the sixty-first floor, the second car 14 would otherwise be stopped between the thirtieth and thirty-first floor until the elevator 10 began to travel again. If, however, a car call was made directing the second car 14 to either the thirtieth or the thirty-first floor, the compensator 38 would release or take up the second plurality of ropes 34 until the second car 14 was at the desired thirtieth or thirty-first floor.

In a third configuration, second car 14 is not a car but rather a vehicle for travel within the hoistway having a predetermined weight. At its lowest position, the first car 12 of the elevator 10 is either stationed at a first floor lobby or at a second floor lobby depending upon the preference of the architect. The vehicle is connected to the first car 12 by the second plurality 34 of ropes in the same manner as described heretofore relative to the second car 14; i.e., the second plurality 34 of ropes extend down the hoistway 18 to a pair of sheaves 36 attached to the top of the vehicle, around the sheaves 36 and back up the hoistway 18. In this case, however, the second plurality 34 of ropes do not attach to a compensator 38, but rather to a fixed position within the hoistway 18 above the cars. The advantage of the vehicle attached to the first car 12 in a 2:1 roping arrangement is that it can be used in a variety of hoistways, new and existing, to minimize or effectively eliminate car jump. The weight of the vehicle is determined by considering a variety of factors such as the weight of the car, the maximum speed of the car, etc.

Although this invention has been shown and described with respect to the detailed embodiments thereof, it will be understood by those skilled in the art that various changes in form and detail thereof may be made without departing from the spirit and scope of the claimed invention. For example, the best mode has been described heretofore as having a drive sheave 24 for imparting motion to the first 12 and second 14 cars and the counterweight 16. Alternatively, the counterweight 16 may include a linear motor for powering the elevator 10. In that case, the drive sheave 24 and the deflector sheaves 26 are both deflector sheaves positioned to align the ropes 32 above the cars 12, 14 and the counterweight 16.

Furthermore, the first 12 and second 14 cars may share a drive machine 30 and a counterweight 16 and not be connected to one another. In this embodiment (not shown), the first plurality of ropes 32 extends from the counterweight 16 to a drive sheave 24 at the top of the hoistway 18, wraps around and extends back down to the first car 12. The second plurality 34 of ropes also extends from the counterweight 16 to a drive sheave 24 at the top of the hoistway 18, but then wraps around the drive sheave 24 and a deflector sheave 26 and then extends down past the first car 12 along the wall of the hoistway 18, outside the path of the first car 12. The second plurality of ropes 34 wrap around a pair of deflector sheaves attached to the top of the second car 14 and finally extends back up the hoistway 18 and attaches to a fixed position above the cars.

I claim:

1. An elevator, comprising:

a hoistway;

a first car, for travel within said hoistway;

a second car, for travel within said hoistway;

a counterweight, for travel within said hoistway;

a plurality of ropes, connecting said first and second cars to said counterweight; and a machine, for driving said cars within said hoistway;

wherein said plurality of ropes are arranged to cause said second car to travel (1/N of) the distance, at (1/N of) speed, of said first car when said machine is driving said cars.

2. An elevator according to claim 1, wherein said second car travels one-half the distance, at one-half the speed, of said first car when said machine is driving said cars.

3. An elevator according to claim 2, wherein said plurality of ropes comprises:

a first plurality of ropes, connecting said first car to said counterweight; and a second plurality of ropes, connecting said second car to said first car, having an effective length;

wherein said first plurality of ropes are fixed to said first car in a 1:1 roping arrangement, and said second plurality of ropes are attached to said second car in a 2:1 roping arrangement.

4. An elevator according to claim 3, wherein said first plurality of ropes attach to said first car on one end, extend up said hoistway above said cars to said machine, around a sheave attached to said machine, and then back down said hoistway and around a sheave attached to said counterweight, and then back up said hoistway and attach to said hoistway above said cars.

5. An elevator according to claim 4, wherein said second plurality of ropes attach on one end to said first car, and thereafter extend down said hoistway to a sheave attached to said second car, around said sheave and back up said hoistway, and attach to said hoistway above said cars.

6. An elevator according to claim 5, further comprising:

a plurality of compensating ropes, wherein said compensating ropes attach to said counterweight and extend down said hoistway to a sheave attached to said hoistway, around said sheave, and up said hoistway to a sheave attached to said second car, around said sheave, and back down said hoistway attaching to said hoistway below said cars.

7. An elevator according to claim 6, further comprising:

a compensator, for compensating the effective length of said second plurality of ropes, wherein said compensator can extend or retract the length of said second plurality of ropes enough to permit the second car to travel to a landing within said hoistway when said first car is stopped at a landing in the hoistway.

8. An elevator according to claim 3, wherein said first plurality of ropes attach to said counterweight on a first end, extend up said hoistway above said cars to said machine, around a sheave attached to said machine, and then back down said hoistway, and attach to said first car on a second end.

9. An elevator according to claim 8, wherein said second plurality of ropes attach on one end to said first car, and thereafter extend down said hoistway to a sheave attached to said second car, around said sheave and back up said hoistway, and attach to said hoistway above said cars.

10. An elevator according to claim 9, further comprising:

a plurality of compensating ropes, wherein said compensating ropes attach to said counterweight and extend down said hoistway to a sheave attached to said hoistway, around said sheave, and up said hoistway to a sheave attached to said second car, around said sheave, and back down said hoistway attaching to said hoistway below said cars.

11. An elevator according to claim 10, further comprising:

a compensator, for compensating the effective length of said second plurality of ropes, wherein said compensator can extend or retract the length of said second plurality of ropes enough to permit the second car to travel to a landing within said hoistway when said first car is stopped at a landing in the hoistway.

12. An elevator, comprising:

a hoistway;

a car, for travel within said hoistway;

a weighted vehicle, for travel within said hoistway;

a counterweight, for travel within said hoistway;

a plurality of ropes, connecting said car and said vehicle to said counterweight; and a machine, for driving said car and said vehicle within said hoistway;

wherein said plurality of ropes are arranged to cause said vehicle to travel (1/N of) the distance, at (1/N of) the speed, of said first car when said machine is driving said vehicle and said car;

wherein said vehicle acts against the inertia of said car in the event said counterweight is stopped traveling in a downward direction.

13. An elevator according to claim 12, wherein said vehicle travels one-half the distance, at one-half the speed, of said first car when said machine is driving said vehicle and said car.

14. An elevator according to claim 13, wherein said plurality of ropes comprises:

a first plurality of ropes, connecting said first car to said counterweight; and a second plurality of ropes, connecting said weighted vehicle to said first car;

wherein said first plurality of ropes are fixed to said first car in a 1:1 roping arrangement, and said second plurality of ropes are attached to said vehicle in a 2:1 roping arrangement.

15. An elevator according to claim 14, wherein said second plurality of ropes attach on one end to said first car, and thereafter extend down said hoistway to a sheave attached to said vehicle, around said sheave and back up said hoistway, and attach to said hoistway above said car and vehicle.

16. An elevator according to claim 15, further comprising:

a plurality of compensating ropes, wherein said compensating ropes attach to said counterweight and extend down said hoistway to a sheave attached to said hoistway, around said sheave, and up said hoistway to a sheave attached to said vehicle, around said sheave, and back down said hoistway attaching to said hoistway below said cars.

17. A method for reducing car jump in an elevator, comprising the steps of:

providing a car and a counterweight for travel in a hoistway;

providing a first plurality of ropes for connecting said car and counterweight, wherein said first plurality of ropes extend between said car and counterweight in a 1:1 roping arrangement;

providing a weighted vehicle for travel in the hoistway below the car, said vehicle including a deflector sheave attached to said vehicle;

providing a second plurality of ropes;

attaching one end of said second plurality of ropes to said car;

routing said second plurality of ropes down said hoistway from said car, to and around said deflector sheave, and back up said hoistway;

attaching an other end of said second plurality of ropes to a fixed position in said hoistway;

wherein said routing of said second plurality of ropes causes said vehicle to travel half the distance, at half the speed, of said car; and wherein said vehicle acts against the inertia of said car in the event said counterweight is stopped traveling in a downward direction.

18. A method for reducing car jump according to claim 17, wherein said vehicle is a second car for carrying passengers.

19. A method to operate an elevator system having a pair of elevator cars in a single hoistway, the cars being driven by a single drive means and being roped together in an arrangement providing for conjoined movement of the pair of cars through the hoistway, the roping arrangement including a compensator that is adjustable in length, the hoistway having a plurality of landings, the method comprising the steps of:

moving the pair of cars through the hoistway until one of the pair of cars is level with a desired landing; and leveling the other of the pair of cars with a second desired landing by adjusting the length of the compensator.

* * * * *